US011243050B2

(12) United States Patent
Cigard et al.

(10) Patent No.: US 11,243,050 B2
(45) Date of Patent: Feb. 8, 2022

(54) PLATE CARRIER ABSORPTION OF SHOCK FROM MOVEMENT OF WEARER

(71) Applicant: 5.11, Inc., Manteca, CA (US)

(72) Inventors: Tyler Cigard, Irvine, CA (US); Katelyn Fukushima, Irvine, CA (US); Sharon Park, Irvine, CA (US)

(73) Assignee: 5.11, INC., Modesto, CA (US)

( * ) Notice: Subject to any disclaimer, the term of this patent is extended or adjusted under 35 U.S.C. 154(b) by 316 days.

(21) Appl. No.: 16/203,382

(22) Filed: Nov. 28, 2018

(65) Prior Publication Data

US 2020/0166313 A1 May 28, 2020

(51) Int. Cl.

| | |
|---|---|
| ***F41H 1/02*** | (2006.01) |
| ***A41D 13/05*** | (2006.01) |
| ***A41D 13/00*** | (2006.01) |
| *F41H 5/013* | (2006.01) |

(52) U.S. Cl.

CPC ..... *F41H 1/02* (2013.01); *A41D 13/0002* (2013.01); *A41D 13/0518* (2013.01); *A41D 13/0593* (2013.01); *F41H 5/013* (2013.01)

(58) Field of Classification Search

CPC ..... F41H 1/02; A41D 13/0012; A41D 13/015; A41D 13/05; A41D 13/0518; A41D 2400/48; A41D 27/20

See application file for complete search history.

(56) References Cited

U.S. PATENT DOCUMENTS

| | | | | | |
|---|---|---|---|---|---|
| 478,076 | A | | 7/1892 | Asten | |
| 784,527 | A | | 3/1905 | Vernon | |
| 939,871 | A | * | 11/1909 | Sherman | A41D 13/0012 2/94 |
| 1,131,054 | A | * | 3/1915 | Glassman | A41D 13/0012 2/94 |
| 1,198,059 | A | * | 9/1916 | Ross | A41D 13/0012 2/94 |
| 1,324,234 | A | * | 12/1919 | Daigre | F41H 1/02 2/2.5 |
| 1,495,489 | A | | 5/1924 | Leo | |
| 2,517,615 | A | | 8/1950 | Paul et al. | |

(Continued)

FOREIGN PATENT DOCUMENTS

| | | |
|---|---|---|
| EP | 2476327 | 7/2012 |
| WO | 0048480 | 8/2000 |

(Continued)

*Primary Examiner* — Sally Haden

(74) *Attorney, Agent, or Firm* — Kilpatrick Townsend & Stockton LLP

(57) ABSTRACT

A plate carrier (such as a vest) is provided having shock absorption capabilities for absorbing shock in response to movement of a plate within the carrier resulting from movement of the wearer. The plate carrier can include a cradle that supports the plate within a pocket from underneath. Stretchable material may be incorporated into the cradle to provide shock absorption. For example, the cradle may include a limit strap hanging to form a first loop and a shock-absorption strap hanging to form a second loop spaced above the first loop. The shock-absorption strap may be formed from a material more stretchable than the limit strap, for example, so that the limit strap provides a limit of plate deflection and shock absorption provided.

17 Claims, 5 Drawing Sheets

(56) References Cited

U.S. PATENT DOCUMENTS 2,853,709 A * 9/1958 Peterson ..... A41D 13/0012 2/51
3,000,119 A 9/1961 Altman
3,452,362 A 7/1969 Korolick et al.
3,754,284 A 8/1973 Hartigan et al.
3,973,275 A 8/1976 Blauer
4,041,549 A 8/1977 Atkinson
4,079,464 A 3/1978 Roggin
4,211,218 A 7/1980 Kendrick
4,266,297 A 5/1981 Atkins
4,422,454 A 12/1983 English
4,485,491 A 12/1984 Rasmussen
4,497,069 A 2/1985 Braunhut
4,507,802 A 4/1985 Small
4,535,478 A 8/1985 Zufle
4,593,788 A 6/1986 Miller
4,745,883 A 5/1988 Baggetta
5,027,833 A 7/1991 Calkin
5,060,314 A 10/1991 Lewis
5,072,453 A 12/1991 Widder
5,157,792 A 10/1992 Allen et al.
5,220,976 A 6/1993 Gunter
5,325,538 A 7/1994 Schoenweiss et al.
5,327,811 A 7/1994 Price et al.
5,331,683 A 7/1994 Stone et al.
5,431,318 A 7/1995 Garcia
5,495,620 A 3/1996 Schoenweiss et al.
5,514,019 A 5/1996 Smith
5,531,292 A 7/1996 Bell
5,564,476 A 10/1996 Golz
5,584,737 A 12/1996 Luhtala
5,617,582 A 4/1997 Burwell
5,644,792 A 7/1997 Tishler et al.
5,644,794 A * 7/1997 Hull ..... A45F 5/02 2/102
5,754,982 A 5/1998 Gainer
5,934,530 A 8/1999 Antczak et al.
5,974,585 A 11/1999 Bachner, Jr.
6,041,444 A 3/2000 McKinney
6,108,816 A 8/2000 Bradley
6,158,642 A 12/2000 Herbage
6,185,738 B1 2/2001 Sidebottom
6,205,584 B1 3/2001 Yocco
6,213,365 B1 4/2001 Stocke et al.
6,233,740 B1 5/2001 Meyers et al.
6,419,132 B1 * 7/2002 Reed ..... A45C 15/00 109/49.5
6,659,689 B1 12/2003 Courtney et al.
6,712,251 B2 3/2004 Godshaw et al.
6,775,846 B1 8/2004 LaFauci et al.
6,800,007 B2 10/2004 Calkin
7,204,468 B2 4/2007 Kintzele et al.
7,240,404 B2 7/2007 Floessner
7,264,023 B2 9/2007 Jackson
7,318,542 B2 1/2008 Godshaw et al.
7,424,748 B1 9/2008 McDunn et al.
7,444,686 B2 11/2008 Stewart
7,490,358 B1 2/2009 Beck
7,536,728 B1 5/2009 Leathers
7,596,815 B2 10/2009 Grilliot et al.
7,610,641 B2 11/2009 Frost
7,699,197 B2 4/2010 Panosian et al.
7,712,148 B2 5/2010 Carlson
7,748,053 B1 7/2010 Hancock
7,770,770 B2 8/2010 Murdoch et al.
7,810,167 B2 10/2010 Seitzinger et al.
7,845,527 B1 12/2010 McMillan et al.
7,917,968 B2 4/2011 Roux
8,002,159 B2 8/2011 Cragg
8,011,545 B2 9/2011 Murdoch et al.
8,015,619 B2 9/2011 McKay et al.
8,025,192 B2 9/2011 Petzl et al.
8,079,503 B1 12/2011 Yeates et al.
8,087,560 B2 1/2012 Crye
8,162,365 B2 4/2012 Escobar
8,430,204 B1 4/2013 Reynolds
8,590,116 B2 11/2013 Dahl
8,608,041 B1 12/2013 Adkisson
8,635,714 B2 1/2014 Hazlett
8,776,266 B1 7/2014 Metz
8,826,462 B2 9/2014 Storms, Jr. et al.
8,898,814 B2 12/2014 Storms, Jr. et al.
9,003,947 B1 * 4/2015 Rittenhouse, Jr. ..... F41H 1/02 89/36.05
9,114,749 B2 8/2015 Ashliman et al.
9,144,294 B2 9/2015 Gregory et al.
9,297,611 B1 * 3/2016 Roccisano ..... F41C 33/041
9,354,023 B1 * 5/2016 Rittenhouse, Jr. ..... F41H 1/02
9,441,916 B2 9/2016 Seuk
9,664,481 B2 5/2017 Alcantra et al.
9,752,854 B1 * 9/2017 Rittenhouse, Jr. ... A41D 31/245
9,874,423 B1 * 1/2018 Hughes ..... A41D 13/0012
9,933,233 B1 * 4/2018 Roccisano ..... F41C 33/041
9,993,039 B2 6/2018 Nykoluk et al.
2003/0146348 A1 8/2003 Douglas et al.
2004/0023574 A1 2/2004 Calkin
2004/0027751 A1 2/2004 Goerke et al.
2005/0179244 A1 8/2005 Schroth
2006/0143763 A1 7/2006 Dawson et al.
2006/0253950 A1 11/2006 Kerr
2006/0288466 A1 12/2006 Bucheit
2007/0044197 A1 3/2007 Turcotte et al.
2007/0192926 A1 8/2007 Fee et al.
2007/0289045 A1 12/2007 Evans et al.
2008/0010730 A1 1/2008 Twito et al.
2008/0256680 A1 10/2008 Peksoz et al.
2008/0289086 A1 11/2008 Grilliot et al.
2009/0117300 A1 5/2009 Thompson
2009/0211000 A1 8/2009 Roux
2009/0272773 A1 * 11/2009 Andrade ..... A47D 13/025 224/153
2009/0282595 A1 11/2009 Branson et al.
2009/0307878 A1 12/2009 Kadas
2009/0320171 A1 12/2009 Kocher et al.
2010/0005555 A1 * 1/2010 Osborne ..... F41H 1/02 2/2.5
2010/0031415 A1 2/2010 Shadid
2010/0162459 A1 7/2010 Bronstein et al.
2010/0224660 A1 9/2010 Gleason
2010/0313329 A1 12/2010 Haynes
2011/0030118 A1 2/2011 Pratchett
2011/0030119 A1 2/2011 Fee et al.
2011/0055992 A1 3/2011 Roux
2011/0191933 A1 8/2011 Gregory et al.
2011/0284322 A1 11/2011 West
2012/0132065 A1 5/2012 Seuk
2012/0167288 A1 7/2012 Chen et al.
2012/0180178 A1 7/2012 Gallo
2012/0180189 A1 7/2012 Crye
2012/0192335 A1 8/2012 Crye
2012/0266344 A1 * 10/2012 Griffin ..... F41H 1/02 2/2.5
2013/0126566 A1 5/2013 Seuk et al.
2013/0139287 A1 * 6/2013 Dovner ..... F41H 1/02 2/2.5
2013/0240588 A1 9/2013 Milligan et al.
2013/0256358 A1 * 10/2013 Beck ..... F41H 1/02 224/641
2014/0090145 A1 4/2014 Strum
2014/0150161 A1 6/2014 Nykoluk
2014/0151424 A1 6/2014 Hexels
2014/0201879 A1 7/2014 Seuk et al.
2014/0237698 A1 8/2014 Murphy et al.
2014/0259249 A1 9/2014 Milligan
2014/0263519 A1 9/2014 Saucedo et al.
2015/0157117 A1 6/2015 Seuk et al.
2015/0257458 A1 9/2015 Nykoluk et al.
2015/0285594 A1 10/2015 Seuk
2015/0359272 A1 12/2015 Murphy et al.
2016/0021941 A1 1/2016 Jen
2016/0270554 A1 * 9/2016 Silverman ..... A41D 1/215
2016/0316830 A1 * 11/2016 Roque ..... A41D 27/28
2017/0318941 A1 * 11/2017 Vaughan ..... F41H 1/02

(56) References Cited

U.S. PATENT DOCUMENTS

| | | | | |
|---|---|---|---|---|
| 2017/0332768 | A1* | 11/2017 | Fraile Nuez | A45F 3/06 |
| 2018/0317635 | A1* | 11/2018 | Quon-Chow | A45F 4/02 |
| 2019/0339044 | A1* | 11/2019 | Arranz | A45C 13/103 |

FOREIGN PATENT DOCUMENTS

| | | |
|---|---|---|
| WO | 0205678 | 1/2002 |
| WO | 2005119162 | 12/2005 |
| WO | 2006134241 | 12/2006 |
| WO | 2007079387 | 7/2007 |
| WO | 2007146797 | 12/2007 |
| WO | 2008072011 | 6/2008 |
| WO | 2008073087 | 6/2008 |
| WO | 2009052769 | 4/2009 |

* cited by examiner

PLATE CARRIER ABSORPTION OF SHOCK FROM MOVEMENT OF WEARER

BACKGROUND

Plate carriers may be utilized in many contexts. Often, plate carriers have a form factor of a vest, for example, including shoulder yokes that rest on a wearer's shoulders and support respective front and back panels that each include pockets for receiving plates. Such a plate is typically a generally rigid body (e.g., with an overall shape that is flat or at least partially curved) and may include ballistic material or non-ballistic material, depending on the context of use for the plate carrier.

For example, for military, law enforcement, or other tactical contexts, a ballistic plate may be inserted and retained within a pocket in a plate carrier to provide protection for the wearer against injury from bullets or other projectiles. The pocket may allow for different sizes of plates, for example. Many plate carriers feature length-adjustable straps to secure different size plates such as large, medium, or small. This may allow for flexibility for a user to select between different plate sizes (e.g., among different footprints and/or thicknesses), such as to customize the plate used for a particular situation and trade-off between weight and level of ballistic protection.

Plate carriers are often also used for athletic training purposes. For example, plate carriers have become increasingly common for people participating in cross-training, weightlifting, or other physical exertion exercises. In such contexts, users will often substitute different weights of non-ballistic weighted plates within the plate carrier for customizing a difficulty or intensity of a work-out.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to plate retention systems in a plate carrier. The plate retention systems can include suitable support features for shock absorption against plate movement caused by movement of the wearer. For example, in use, a wearer of a plate carrier may undergo significant amounts of physical exertion, such as during tactical scenarios or in athletic settings. Movement of the wearer of the plate carrier can result in jostling or movement of the plate within the pocket of the plate carrier. In some situations, movement of the plate may exert uncomfortable forces or effects on the wearer, such as from the plate bouncing against the wearer or exerting momentum against the wearer, which may affect balance or otherwise negatively affect the wearer. Generally, support features disclosed herein provide secure support for a plate in a plate carrier, yet the support system is flexibly resilient to provide shock absorption for the plate and reduce impact or other forces exerted by the plate on the wearer of the plate carrier.

In various examples, the plate carrier includes a cradle with straps that wrap underneath an underside or lowermost edge of a plate within the pocket. Some part of the cradle (such as a part of a strap or of an anchor point) may include material that is more stretchable than other material of surrounding elements in the plate carrier, such as a pocket wall, a different part of the strap, or a separate strap. The difference in stretch capacity of different parts of the plate carrier can enable some parts to readily stretch under load to facilitate shock-absorption while other parts remain relatively stable under load to provide complementary appropriate bounds to the shock-absorption to ensure suitable overall securing of the plate within the plate carrier.

In some examples, the cradle includes a set of support straps that includes a limit strap and a shock-absorption strap. The shock-absorption strap can hang down in a loop spaced over another loop formed by the limit strap. In use, the bottom edge of the plate can rest against the shock-absorption strap. The movement of the wearer may cause movement of the plate that causes the shock-absorption strap to stretch and then return based on the resilience of the shock-absorption strap. In effect, this may absorb energy that the plate is transferring due to movement. The limit strap beneath the shock-absorption strap may provide a lowermost limit for the plate to ensure that the plate does not reach a position or a level of deflection of the shock-absorption strap that may cause damage or failure of the shock-absorption strap.

The cradle may include other arrangements of combinations of materials having differing levels of stretch, elongation, and/or recovery. As one example, the cradle may include stretchable material at an anchor point of a support strap to allow the support strap to move and provide shock absorption. The support strap and/or pocket wall may include a relatively less stretchable material that may retain the plate in place when the wearer is not causing movement of the plate carrier.

Different parts of the cradle may be detachable within the pocket to allow for adjustability. In some examples, the limit strap may be movable to anchor at different points in the pocket to change a position of the lower limit of the limit strap. In some examples, the shock-absorption strap may be capable of re-anchoring differently in the pocket to adjust an amount of tension or otherwise change a level of shock absorption provided by the shock-absorption strap. In some examples, the shock-absorption strap may be attached at least in part to a portion of the limit strap, e.g., such that adjustment of an anchoring location of the limit strap may change an amount of tension of the shock-absorption strap as the shock-absorption strap is wrapped around the underside of the plate. In some examples, the shock-absorption strap may be separated at one end from the limit strap, for example, such that the shock-absorption strap can be attached to the wall in the pocket to adjust the level of shock absorption separately or independently from repositioning of the limit strap to adjust a lower limit of the plate within the pocket.

For a fuller understanding of the nature and advantages of the present invention, reference should be made to the ensuing detailed description and accompanying drawings.

BRIEF DESCRIPTION OF THE DRAWINGS

Various embodiments in accordance with the present disclosure will be described with reference to the drawings.

DETAILED DESCRIPTION

In the following description, various embodiments will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
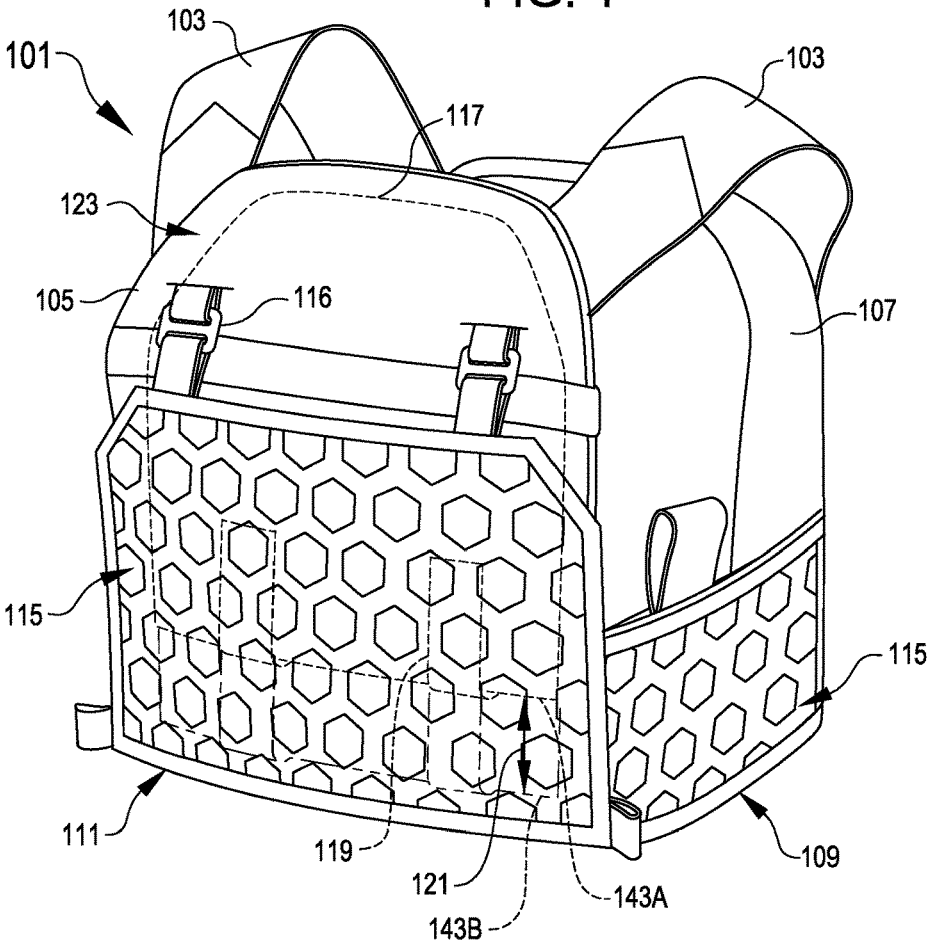
FIG. 1 is a perspective view of an example of a plate carrier having features for providing shock absorption against movement of a plate caused by the wearer's movement, according to certain embodiments.

Referring now to the figures in which features identified with like numbers may refer to like elements across the various figures, FIG. 1 illustrates a plate carrier 101 according to various embodiments. The plate carrier 101 in FIG. 1 is depicted with a form factor of a vest. However, the plate carrier 101 may equally correspond with other forms of bodily-worn garments. For example, features of the plate carrier described herein may equally apply to plates positioned to guard the torso of a wearer, or an appendage of the wearer such as an arm or a leg or part thereof such as a thigh or shoulder, etc.

The plate carrier 101 shown in FIG. 1 includes shoulder yokes 103, a front panel 105, and a rear panel 107. The shoulder yokes 103 may correspond to straps with appropriate padding or other materials for resting on shoulders of a wearer of the plate carrier 101. The shoulder yokes 103 may support the front panel 105 and the rear panel 107 such that the front panel 105 and the rear panel 107 respectively rest along the front and back of the wearer's torso in use. The front panel 105 and rear panel 107 can be connected along a side of the wearer's torso by a cummerbund or waistband 109, which, for example, may be adjustable to accommodate wearers of different sizes.

The plate carrier 101 can include suitable features for the attachment of gear to the plate carrier 101. For example, the plate carrier 101 shown in FIG. 1 includes a front gear attachment platform 111 and a side gear attachment platform 113, each of which are depicted with hexagonal openings 115, such as is described in U.S. Pat. No. 9,664,481 ("the '481 patent"), which is incorporated by reference herein in its entirety. The plate carrier 101 is not limited to such a gear attachment system, however, and additionally or alternatively may include other systems for attachment of gear, which may include, but are not limited to, PALS (Pouch Attachment Ladder System), MOLLE (Modular Lightweight Load-carrying Equipment), and/or other systems also referenced in the '481 patent. Moreover, although gear attachment system features are specifically depicted in FIG. 1 on the front and side of the plate carrier 101, these or other attachment system features may alternatively or additionally be positioned on the back of the plate carrier 101 or any other position suitable for mounting gear. The plate carrier 101 further may be configurable to switch between different gear attachment features. In the arrangement depicted in FIG. 1, for example, the front panel 105 of the plate carrier 101 includes hooks 116 that may facilitate rapid exchange or replacement of the depicted front gear attachment platform 111 with an alternate platform having a different arrangement and/or style of attachment system features.

The plate carrier 101 depicted in FIG. 1 is shown receiving a plate 117 within a pocket 123 within the front panel 105. The plate 117 can be a generally rigid body or exhibit a degree of flexibility to allow some amount of conforming to a body part of the wearer or other shape. Any suitable shape of the plate 117 can be used, including but not limited to flat or at least partially curved. The plate 117 can be a uniform thickness or vary in thickness to provide a desired contour, for example, to match a contour of a body part along which the plate 117 is to be positioned in use. The plate 117 may correspond to ballistic material or weighted material, depending on the application or use desired by the wearer of the plate carrier 101. Non-limiting examples of types of material that may be included in the plate 117 can include ceramic (such as boron carbides), metal (such as steel, titanium, aluminum, or alloys), fabric (such as aramid fabrics), plastic (such as ultra-high molecular weight polyethylene), or polymer. In some examples, a ballistic plate and a non-ballistic weighted plate may feature similar materials (such as metal) but may differ as to the presence or absence of a ballistic rating due to differences in number of layers, thickness of layers, combination with other materials, or other variations in configuration.

The plate carrier 101, although depicted in FIG. 1 specifically with the plate 117 visible in the front panel 105, may additionally or alternatively include a pocket 123 for receiving a plate 117 in the rear panel 107, although this is omitted from the view in FIG. 1 for the sake of clarity and to not obscure other features shown in FIG. 1.

The plate carrier 101 depicted in FIG. 1 is shown with a cradle 119 that supports the plate 117 within the plate carrier 101. The cradle 119 may elastically support the plate 117 so that the plate 117 may shift responsive to movement of the plate carrier 101, yet resiliently return to its supported position due to the resilient and elastic nature of the cradle 119. To this end, the cradle 119 can include or be coupled with a component that stretches to allow a limited amount of movement of the plate 117 within the pocket 123 (e.g., as depicted by arrow 121). The movement afforded by the cradle 119 may allow adequate displacement of the plate 117 within the pocket 123 to permit shock absorption of the plate 117 and reduce discomfort that the wearer of the plate carrier 101 might otherwise experience in the absence of such shock absorption.

In some aspects, an amount or degree of shock absorption may be characterized or quantified in terms of a corresponding amount of displacement of a lower or bottom edge 143 of the plate 117. For example, in FIG. 1, the bottom edge 143 is identified by reference numbers 143A and 143B respectively corresponding to alternate positions A and B of the plate 117 at opposite ends of a range of movement indicated by double-headed arrow 121. The movement shown by arrow 121 may not be to scale and may be exaggerated for the sake of visibility in the illustration. Differing amounts of displacement may suitably provide shock absorption. In one illustrative example, with a plate 117 having a height of 10 inches, features of the plate carrier 101 may allow the bottom edge 143 of the plate 117 to displace by up to 1.25 inches to permit shock absorption. Other sizes of the plate 117 and/or amounts of deflection may also be suitable. For example, in some embodiments, a suitable amount of deflection to provide shock absorption may be in the range of 0.25 inches to 2 inches. In some embodiments, a suitable range may be smaller or larger and/or have different end points. For example, in some embodiments, a suitable amount of deflection to provide shock absorption may be in the range of 0.5 inches to 1.5 inches. In some embodiments, a suitable amount of deflection to provide shock absorption may be in the range of 0.5 inches to 1 inch.

The plate carrier 101 can include suitable materials for facilitating uses and functions of the plate carrier 101 disclosed herein. For example, on one hand, shock-absorbing properties of the plate carrier 101 can be achieved by including suitable stretchable or elastic material capable of elongation and recovery (e.g., exhibiting a memory to return toward its initial shape after stretching). Non-limiting examples of the stretchable material may include rubber, an imitative rubber synthetic, elastane, knits, or blends (such as polyester-elastane) The stretchable material can be incorporated, for example, among various parts of the cradle, including, but not limited to a strap or an anchor, e.g., as discussed in greater detail below. On the other hand, stability properties of the plate carrier 101 can be achieved by including suitable load-bearing material. Non-limiting examples may include compositions such as polyester, polypropylene, or nylon, and these or other suitable materials may be incorporated into suitable form factors such as, but not limited to, fabrics or webbing. The load-bearing material can be incorporated, for example, in pocket walls and/or parts of the cradle 119 that supplement the stretchable material, e.g., as discussed in greater detail below. Generally, different parts of the plate carrier 101 can include different types of material to achieve a balance between providing shock absorption in response to a wearer's movement and providing adequate support of the plate 117 upon cessation of—or in other absence of—movement by the wearer.

Figure 2:
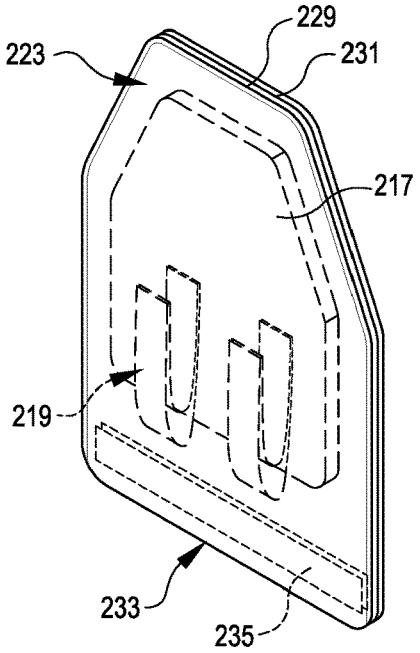
FIG. 2 is a perspective view showing features inside a pocket that may be utilized within the plate carrier of FIG. 1, according to certain embodiments.

FIG. 2 illustrates various features shown relative to a pocket 223, which may be an example of the pocket 123 of FIG. 1. Likewise, other features shown in FIG. 2 may be similar to features identified with similar name and/or number to those in FIG. 1 and may be included in the plate carrier 101. As such, description of various aspects of these features are not repeated.

The pocket 223 may be formed by a first wall 229 and a second wall 231. The first wall 229 and the second wall 231 can be stitched together or otherwise joined together at multiple edges and open along at least one edge. For example, the pocket 223 may include or define an open end or opening 233 that provides access into the inside of the pocket 223. Although FIG. 2 depicts the opening 233 at a bottom of the pocket 223, the opening 223 may alternatively be positioned along any suitable edge of the pocket 223, including but not limited to a lateral side or top of the pocket 223. In use, the plate 217 can be moved through the opening 233 to be inserted into the pocket 223 and/or to be removed from the pocket 223. The opening 233 may be accompanied by a closure 235 that may be utilized to shut the opening 233 of the pocket 223 and further secure the plate 217 in the pocket 223. The closure 235 may correspond to hook and loop fasteners, zippers, snaps, or any other suitable releasable mechanism for releasably securing two structures together. The plate 217 can be supported in the pocket by the cradle 219, which may include features described in more detail with respect to FIG. 3.

Figure 3:
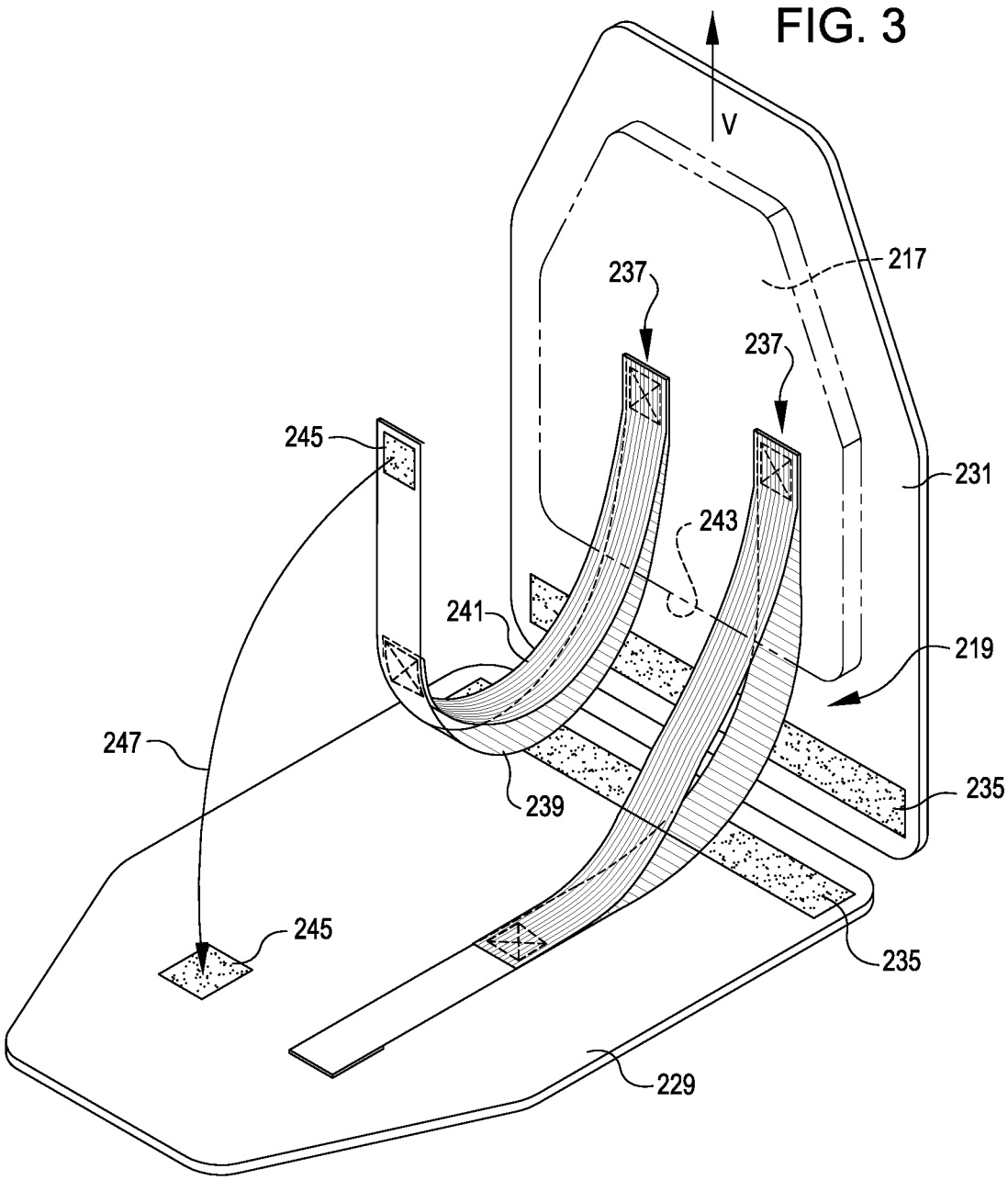
FIG. 3 is a partially exploded view of the pocket of FIG. 2, according to certain embodiments.

FIG. 3 illustrates a partially exploded view of the pocket 223 of FIG. 2. The cradle 219 is depicted in FIG. 3 with two strap assemblies 237. However, any suitable number of strap assemblies may alternatively be used, including, but not limited to, one, two, three, or more than three. For simplicity, an individual strap assembly 237 will be now described.

The strap assembly 237 can support the plate 217 from underneath in the vertical direction of the pocket 223 (illustrated by the arrow V). The vertical direction V may be aligned with the direction of gravity when the carrier is worn by the wearer and when the wearer is in an upright position.

The strap assembly 237 in FIG. 2 is depicted with a relatively narrow width compared to a total width of the plate 117 and extends less than the total width of the plate 117. However, the strap assembly 237 is not so limited and may correspond to a form factor of a flap or other structure with a greater width, such as approximately as wide as or wider than the plate 117. In general, the strap assembly 237 may feature any suitable width for supporting the plate 217 from underneath, e.g., individually or in conjunction with one or more other strap assemblies 237.

The strap assembly 237 shown in FIG. 3 features a set of support straps that includes a limit strap 239 and a shock-absorption strap 241. The limit strap 239 can be attached at upper positions to the interior of the pocket 223 and hang down or drape to form a first loop. Similarly, the shock-absorption strap 241 may also hang within the interior of the pocket 223 and form a second loop. The shock-absorption strap 241 may be stretchable from an unstretched state. In the unstretched state, the second loop formed by the shock-absorption strap 241 can be spaced above the first loop of the limit strap 239 in the vertical direction V. For example, one construction that may achieve such spaced apart loops is shown in FIG. 3 and includes the limit strap 239 having a first unstretched length, the shock-absorption strap 241 having a second unstretched length shorter than the first unstretched length of the limit strap 239, and the shock-absorption strap 241 being attached at both ends to the limit strap 239.

The strap assembly 237 can be at least partially releasable to allow placement of the plate 217 in the pocket 223 and/or facilitate adjustment of the strap assembly 237. For example, in FIG. 3, the limit strap 239 is shown fixedly attached (e.g., via stitching or other technique) to the second wall 231 and releasably attached to the first wall 229 (e.g., via releasable fasteners 245 that are depicted as hook and loop fasteners, but may additionally or alternatively correspond to zippers, snaps, or any other suitable releasable mechanism for releasably attaching two structures together). In operation, a user may start with the limit strap 239 in an at least partially detached state, insert the plate 217 into the pocket 223, wrap or fold the strap assembly 237 under the bottom edge 243 of the plate 217, and connect the limit strap 239 to the first wall 229 (e.g., such as shown at arrow 247). Connecting the limit strap 239 to the interior of the pocket 223 so that the limit strap 239 is looped or doubled under the bottom edge 243 of the plate 217 may secure the plate 217 within the pocket 223, for example, resulting in an arrangement such as shown in FIG. 4.

Figure 4:
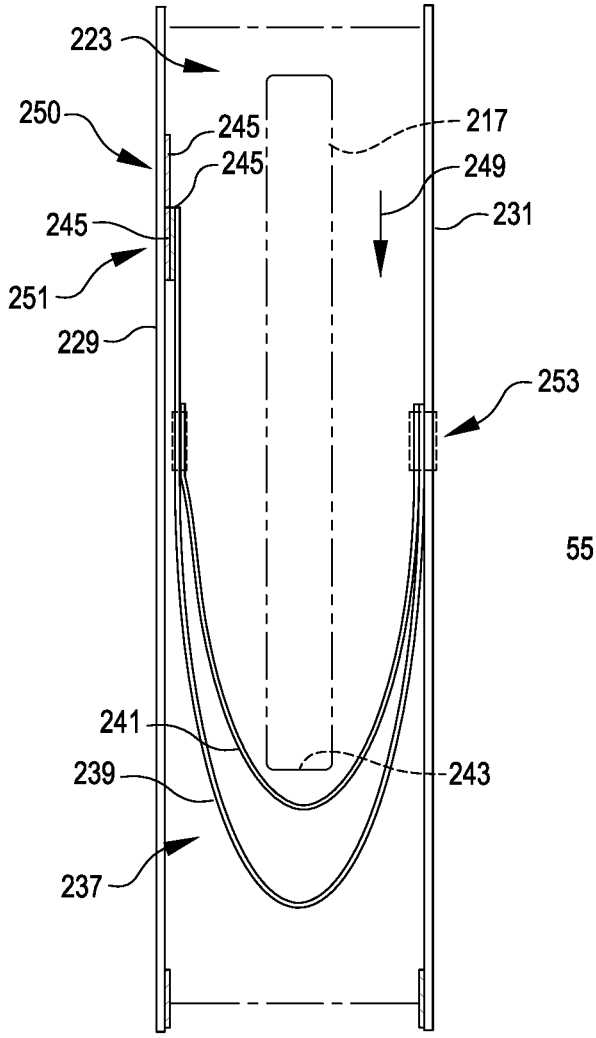
FIG. 4 is a side view showing one example of a cradle that may utilized within the pocket of FIG. 2, according to certain embodiments.

FIG. 4 depicts a side view of the plate 217 received within the pocket 223 and positioned above the strap assembly 237 (e.g., which may correspond to a state upon completion of an operation of installing the plate 217 and attaching the strap assembly 237 around the bottom edge 243 of the plate 217). The arrangement of elements in FIG. 4 may correspond to a top of the plate 217 having been pushed into engagement with a top of the pocket 223 and before being released to move under the influence of gravity into engagement with the strap assembly 237. Hence, for illustrative purposes, FIG. 4 illustrates a gap between the bottom edge 243 of the plate 217 and the shock-absorption strap 241 for ease of distinguishing between elements in the figure, although in practice, the plate 217 may remain engaged or in contact with the shock-absorption strap 241 while the wearer is upright.

The arrangement in FIG. 4 includes the strap assembly 237 releasably attached with the first wall 229 at a first anchor point 251 (e.g., by hook and loop fasteners) and fixedly attached to the second wall 231 at a second anchor point 253 (e.g., by stitching). The first anchor point 241 and the second anchor point 253 are shown located at different elevations within the pocket 223 in FIG. 4, although in some arrangements, the respective elevations may be the same as one another The shock-absorption strap 241 may have one or both ends attached to the limit strap 239 at the first anchor point 251, at the second anchor point 253, or at a position between the first anchor point 251 and the second anchor point 253.

Referring to FIG. 4, it may be appreciated that the shock-absorption strap 241 may be positioned to be between the plate 217 and the limit strap 239 in use. For example, the shock-absorption strap 241 may have a plate-facing side that will engage the plate 217 and an opposed side that faces the limit strap 239. The shock-absorption strap 241 may have sufficient strength to hold the plate 217 above the limit strap 239 in the absence of movement by the wearer, for example, such that the loop formed by the limit strap 239 in such state is spaced apart from the bottom edge 243 of the plate 217.

In operation, in response to movement of the wearer, the plate 217 may move within the pocket 223. For example, the plate 217 may be move downward as depicted by the arrow 249. Downward motion may cause the plate 217 to act on the shock-absorption strap 241 and cause stretching (e.g., elongation or deflection) of the shock-absorption strap 241. Engagement with the shock-absorption strap 241 may expend or absorb energy from the movement of the plate. The plate 217 may also be urged back up in a direction opposite the arrow 249 by a resilience exhibited by the shock-absorption strap 241. In some examples, the shock-absorption strap 241 may stretch in response to movement of the plate 217 by a sufficient amount to elongate into contact with the limit strap 239. In this manner, the limit strap 239 may provide a lower limit of displacement of the plate 217. A lower limit may provide a safeguard against the shock-absorption strap 241 from stretching beyond a limit at which the shock-absorption strap 241 may break or otherwise undergo damage.

To facilitate described functions, the shock-absorption strap 241 may be constructed of a different material than the limit strap 239. The respective straps of the strap assembly 237 may exhibit different elongation and recovery characteristics. As an illustrative example, the shock-absorption strap 241 may be a band of elastic or other material that is more readily stretchable than a band of load-bearing webbing that may form the limit strap 239. More generally, the respective straps of the strap assembly 237 may exhibit respective levels of force-responsive extension that differ by an amount that facilitate the respective functions of the straps, such as shock absorption or providing a lower limit for deflection of the plate 217.

The strap assembly 237 may also permit adjustability of a degree of shock absorption provided in use. For example, a user may detach the strap assembly 237 from the first anchor point 251 and re-attach the strap assembly 237 at a different elevation in the pocket 228 (e.g., at a higher or lower portion of the first anchor point 251 or other part of the first wall 229, such as at an alternate anchor point 250 depicted in FIG. 4 that may correspond to hook or loop or other fastening feature different in location and/or type from that of the first anchor point 251). Such adjustment may simultaneously adjust the amount of tension present in the shock-absorption strap 241 (e.g., and thereby alter a degree of shock-absorption) and a position of the lower limit of deflection of the plate 217. For example, detaching the strap assembly 237 from the first anchor point 251 and re-attaching the strap assembly 237 to the alternate anchor point 250 may increase a tension in the shock-absorption strap 241 or otherwise decrease an amount of space between the respective loops formed by the shock-absorption strap 241 and the limit strap 239, which may in turn affect an amount that the bottom edge 243 of the plate 217 can deflect for absorbing shock. As an illustrative example, the strap assembly 237 may be moved from being anchored at a first elevation to being anchored at a second elevation in the pocket to reduce an amount of available displacement from 1.25 inches to 0.5 inches (or other respective amounts) and thereby reduce an amount of shock absorption that will be provided by the plate carrier 101 in use. In some embodiments, the strap assembly 237 may be sized to allow the strap assembly 237 to be anchored sufficiently high in the pocket 223 to cause the shock-absorption 241 to come into contact with the limit strap 239 or otherwise be positioned in a pre-stretched state that effectively reversibly disables the shock-absorption capability.

Other arrangements are also possible and may provide shock-absorbing effects. For example, where the arrangement in FIG. 4 includes the strap assembly 237 releasably attached at the first anchor point 251 (e.g., by hook and loop fasteners) and fixedly attached at the second anchor point 253 (e.g., by stitching), other variations may be possible. One example is shown in FIG. 5.

Figure 5:
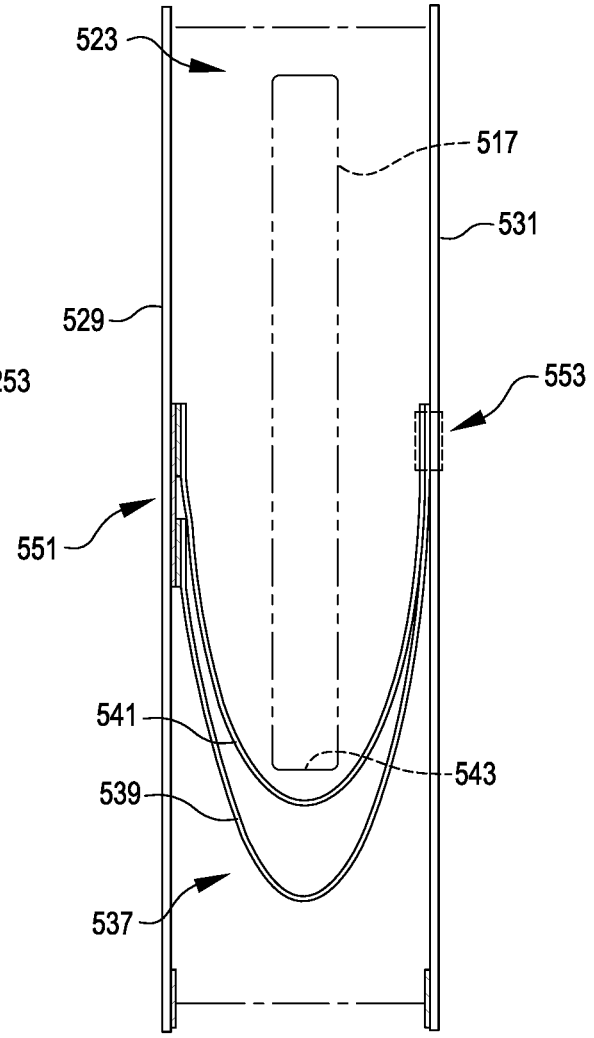
FIG. 5 is a side view showing an example of a cradle in which a shock-absorption strap is secured separately from a limit strap, according to certain embodiments.

FIG. 5 illustrates various features shown relative to a pocket 323, which may be an example of the pocket 123 of FIG. 1. Likewise, other features shown in FIG. 5 may be similar to features identified with similar name and/or number to those in FIGS. 1-4 and may be included in the plate carrier 101. As such, description of various aspects of these features are not repeated.

In particular, FIG. 5 depicts a strap assembly 537 in which the shock-absorption strap 541 is independently attached to the second wall 531 at a position distinct from where the limit strap 539 attaches to the second wall 531. Independent attachment may allow independent or separate adjustment of the shock-absorption strap 541 and the limit strap 539. For example, the shock-absorption strap 541 may be releasably attached at a first position and releasably attachable to a second position to adjust a degree of shock absorption that will be provided by the shock-absorption strap 541. Adjusting the attachment position of the shock-absorption strap 541, for example, may correspond to the shock-absorption strap 541 being drawn into a greater or lesser amount of tension around the bottom edge 543 of the plate 217.

The limit strap 549 being independently attachable, detachable, and re-attachable along a part of the first wall 5291 may allow the limit strap 539 to be adjusted in terms of a position of a lower limit for the plate 217. Adjustability of either or both of the respective parts of the strap assembly 537 may also permit adjustability relative to different sizes of plates 517 that may be introduced into the pocket 523. Moreover, although FIG. 5 depicts each of the shock-absorption strap 541 and limit strap 539 as releasably attached from a first anchor point 551 at the first wall 529 and fixed at a second anchor point 553 on the second wall 531, the respective parts of the strap assembly 537 may additionally or alternatively be releasably attached independently or collectively from the second wall 531.

Figure 6:
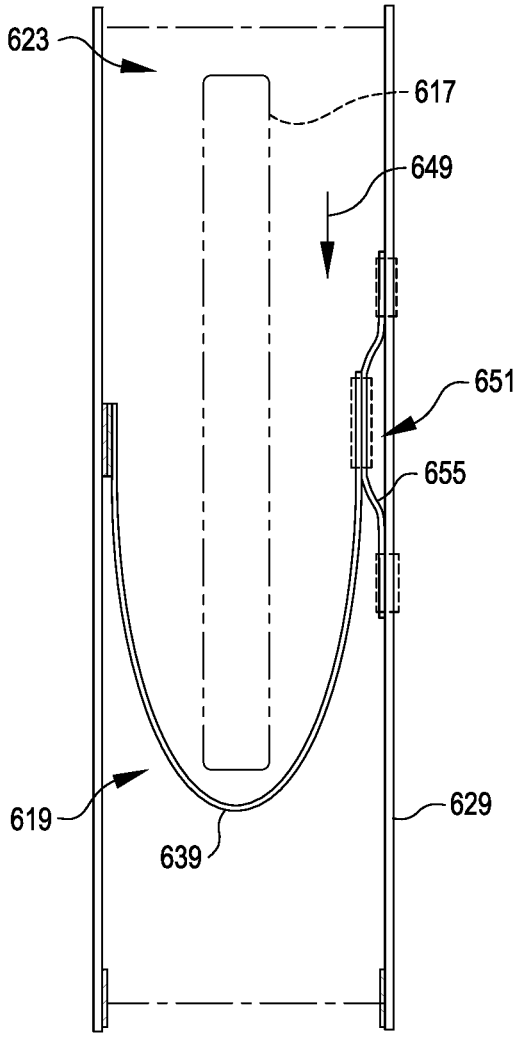
FIG. 6 is a side view showing an example of a cradle in which stretchable material in an anchor may provide shock absorption, according to some embodiments.

In some embodiments, shock absorption may be provided by other arrangements or combinations of materials. One example is shown in FIG. 6. FIG. 6 illustrates various features shown relative to a pocket 623, which may be an example of the pocket 123 of FIG. 1. Likewise, other features shown in FIG. 6 may be similar to features identified with similar name and/or number to those in FIGS. 1-5 and may be included in the plate carrier 101. As such, description of various aspects of these features are not repeated.

In particular, in FIG. 6, a plate 617 is shown in a pocket 623 relative to a cradle 619. The cradle 619 includes a support strap 639. One end of the support strap 639 is attached via an anchor 651 to a wall 629 of the pocket 623. The anchor 651 can include a portion 655 of stretchable material, which may differ from a composition of base material incorporated into the wall 629 and/or material of the support strap 639. For example, the base material of the wall 629 and/or the material of the support strap 639 may be load-bearing material or otherwise less stretchable than the portion 655 of stretchable material. The portion 655 of stretchable material may allow for shock absorption in use. For example, in operation, the plate 617 may move downward in a direction indicated by arrow 649 and exert adequate force to cause the portion 655 of stretchable material to stretch and allow displacement of the support strap 639 within the pocket 623. The portion 655 of stretchable material may also exhibit a memory that causes the material to have a tendency to return toward its unstretched state, which may exert a biasing force against the plate 617 to cause it to travel in an upward direction contrary to the arrow 649, for example, upon the cessation of movement that would cause the downward motion of the plate 617.

In some embodiments, the plate may be secured by an arrangement that varies from the previously discussed arrangements in which the cradle is attached to opposite walls within the pocket. The arrangements herein are not limited to arrangements in which the cradle attaches to opposite walls of the pocket. One example is shown in FIG. 7.

Figure 7:
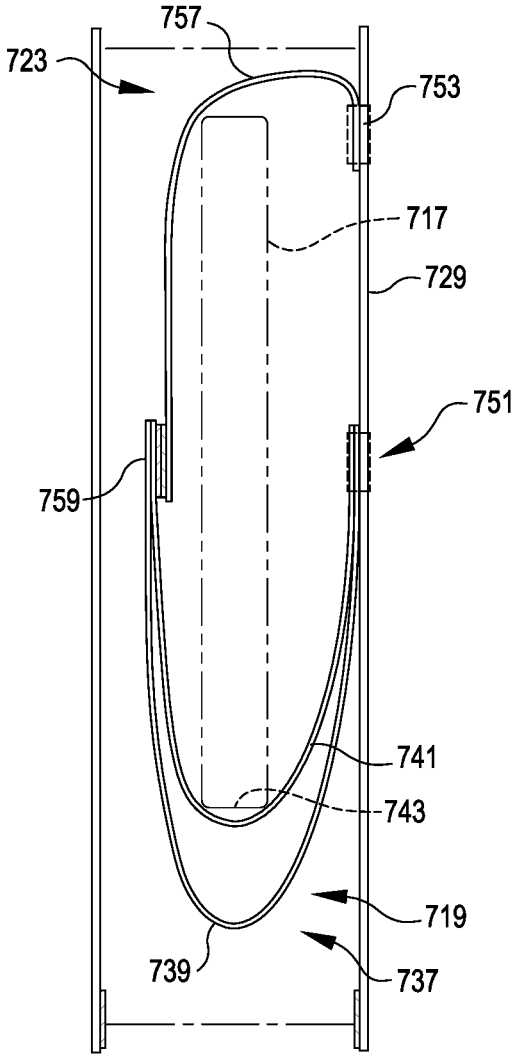
FIG. 7 is a side view showing an example of a cradle in which straps of the cradle attach to a shared wall of the pocket, according to certain embodiments.

FIG. 7 illustrates various features shown relative to a pocket 723, which may be an example of the pocket 123 of FIG. 1. Likewise, other features shown in FIG. 7 may be similar to features identified with similar name and/or number to those in FIGS. 1-6 and may be included in the plate carrier 101. As such, description of various aspects of these features are not repeated.

In particular, FIG. 7 depicts a side view of a cradle 719 in which a strap assembly 737 is anchored at a first anchor point 751 on a first wall 729 by straps that are ultimately wrapped around the plate 717 to attach at a second anchor point 753 also on the first wall 729. The strap assembly 737 can include one or more straps connectable to reach from the respective anchor points 751 and 753 on the same first wall 729. For example, in the arrangement shown in FIG. 7, the strap assembly 737 includes the limit strap 739, a shock-absorption strap 741, and an anchor strap 757. The anchor strap 757 extends from the second anchor point 753 on the first wall 729 to provide an attachment interface for receiving the other portion of the strap assembly 737, e.g., the limit strap 739 and/or shock-absorption strap 741. For example, in use, a user may pull the anchor strap 757 over the top of the plate 717 and pull the limit strap 739 over the bottom edge 743 of the plate and connect at the attachment point 759 to secure the plate 717 within the pocket 723. Alternatively, in some embodiments, the strap assembly 737 may include an attachment point 759 that may be moved fully around the plate 717 to engage the second anchor point 753 without an intervening anchor strap 757. In such case, the limit strap 739 and attachment point 759 may be drawn over the top of the plate 717 to reach the second anchor point 253. In either case, the act of moving the limit strap 739 to secure the plate 717 may cause the shock-absorption strap 741 to come into contact with the bottom edge 743 of the plate 717, for example, to allow shock absorption in response to movement of the plate 717 triggered by movement of the wearer.

In some embodiments, elements of the cradle may be fixedly attached rather than removably attached to respective walls of the pocket. On example is depicted in FIGS. 8 and 9.

Figure 8:
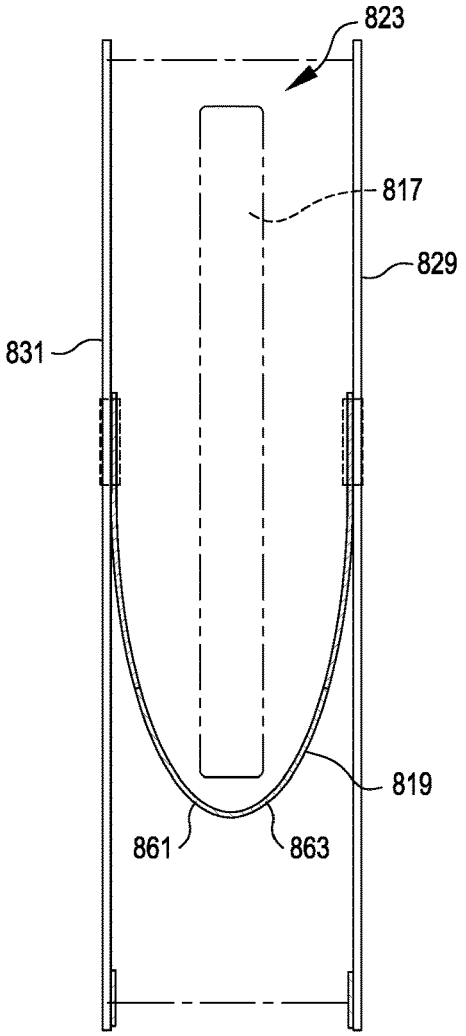
FIG. 8 is a side view showing an example of a cradle in which a strap is attached to opposite walls of the pocket, according to certain embodiments.
Figure 9:
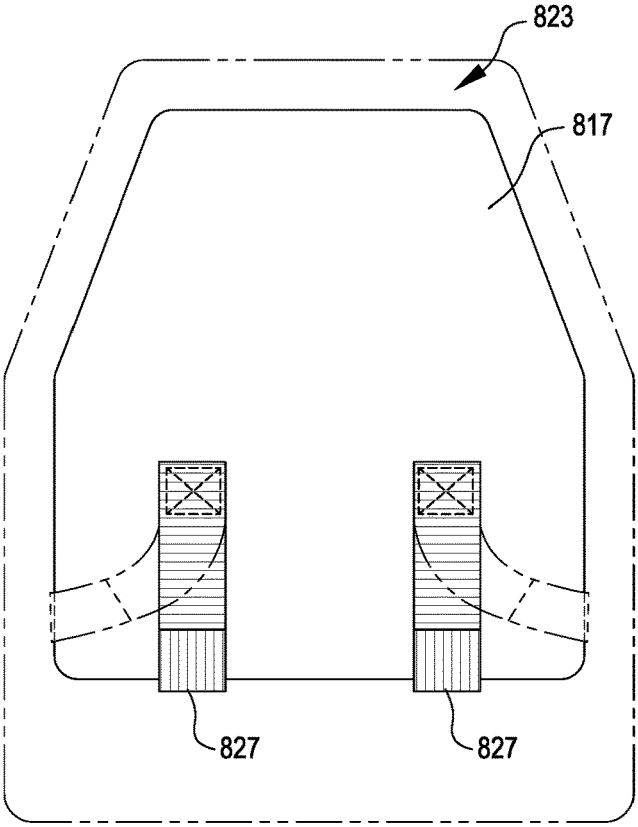
FIG. 9 is a front view showing a cradle in which straps of the cradle may be moved laterally to permit a plate to be inserted or removed from a pocket, according to certain embodiments.

FIG. 8 illustrates various features shown relative to a pocket 823, which may be an example of the pocket 123 of FIG. 1. Likewise, other features shown in FIG. 8 may be similar to features identified with similar name and/or number to those in FIGS. 1-7 and may be included in the plate carrier 101. As such, description of various aspects of these features are not repeated.

In particular, FIG. 8 depicts a side view of a plate 817 received relative to a cradle 819. Although a single strap is shown for the cradle 819, the cradle 819 may alternatively correspond to multiple straps such as a limit strap and shock-absorption strap described earlier herein. In some examples, the cradle 819 may correspond to a single strap having a first segment 861 and second segment 863 that may have differing elongation or recovery characteristics. Including different types of material within the single strap of the cradle 819 may reduce a risk of failure that might be present if the strap of the cradle 819 was made entirely of readily elongated material. In some examples (e.g., reflected at least in FIG. 8), the cradle 819 that is fixedly attached to opposite walls of the first wall 829 and second wall 831 may still permit a plate 817 to be inserted into the pocket 823. For example, with respect to FIG. 9, the plate 817 may be inserted into the pocket 823 while the strap assembly 827 are splayed out to the sides, such as depicted in phantom lines in FIG. 9, for example. Such operation may allow the plate to be inserted or removed from the pocket even though the strap assembly 827 may be fixedly anchored to the opposite walls and not releasably anchored as in other drawings herein. In various examples, the splaying may correspond to displacement in a horizontal direction non-parallel to the vertical direction of the pocket 823.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein, including cited in any contemporaneously filed Information Disclosure Statement, are hereby incorporated by reference to the same extent as if each reference were individually and specifically indicated to be incorporated by reference and were set forth in its entirety herein.

What is claimed is:

1. A plate retention system, comprising:

a carrier configured to be worn on a body of a wearer;

a pocket for removably receiving a plate of ballistic material, the pocket coupled with the carrier and configured to be located along the body of the wearer when the carrier is worn by the wearer, the pocket having a vertical direction configured to be aligned with a direction of gravity when the carrier is worn by the wearer when the wearer is in an upright position, and an interior of the pocket being formed at least in part by a first wall and a second wall facing one another; and a cradle configured for supporting the plate within the pocket from underneath the plate in the vertical direction, the cradle comprising:

a limit strap connected to the first wall and the second wall of the pocket and hanging to form a first loop, wherein the limit strap is attached at a first anchor point to the first wall and at a second anchor point to the second wall; and a shock-absorption strap stretchable from an unstretched state, the shock-absorption strap in the unstretched state hanging to form a second loop arranged to support the plate in a position spaced above the first loop in the vertical direction when the plate is at rest within the pocket, the shock-absorption strap configured to receive a bottom edge of the plate, the shock-absorption strap configured to stretch in the vertical direction so as to provide shock absorption in response to movement of the plate resulting from movement of the wearer when the carrier is worn.

2. The plate retention system of claim 1, wherein the shock-absorption strap comprises a resilient material configured to return toward the unstretched state to urge the plate upward in the pocket opposite the direction of gravity.

3. The plate retention system of claim 1, wherein the shock-absorption strap is configured to stretch to contact the limit strap in response to the movement of the plate resulting from the movement of the wearer when the carrier is worn such that the limit strap provides a lower limit of movement for the plate.

4. The plate retention system of claim 1, wherein an end of the shock-absorption strap is attached to the limit strap at the first anchor point, at the second anchor point, or at a position between the first anchor point and the second anchor point.

5. The plate retention system of claim 4, wherein the limit strap is releasably attached at the first anchor point, releasably attached at the second anchor point, or releasably attached at the first anchor point and at the second anchor point, wherein the limit strap is configured to releasably attach at another position to adjust a degree of shock-absorption provided by the shock-absorption strap.

6. The plate retention system of claim 1, wherein the limit strap is releasably attached at the first anchor point, releasably attached at the second anchor point, or releasably attached at the first anchor point and at the second anchor point, wherein the limit strap is configured to releasably attach at another position to adjust a position of a lower limit of movement for the plate provided by the limit strap.

7. The plate retention system of claim 1, wherein an end of the shock-absorption strap is attached to the first wall or the second wall separately from the first anchor point and the second anchor point.

8. The plate retention system of claim 1, wherein an end of the shock-absorption strap is releasably attached at a first position and releasably attachable at a second position to adjust a degree of shock-absorption provided by the shock-absorption strap.

9. The plate retention system of claim 1, wherein the limit strap comprises a first band of load-bearing webbing material and the shock-absorption strap comprises a second band of elastic material.

10. A plate retention system, comprising:

a carrier configured to be worn on a body of a wearer;

a pocket for removably receiving a plate, the pocket coupled with the carrier and configured to be located along the body of the wearer when the carrier is worn by the wearer, the pocket having a vertical direction configured to be aligned with a direction of gravity when the carrier is worn by the wearer when the wearer is in an upright position, and an interior of the pocket being formed at least in part by a first wall and a second wall facing one another; and a cradle configured for supporting the plate within the pocket from underneath the plate in the vertical direction, the cradle comprising:

a limit strap connected at a first upper location and a second upper location to the interior of the pocket and hanging to form a first loop, the limit strap having a limit strap length extending downward and upward along the first loop, the limit strap length measured along the first loop and between a first limit strap terminus and a second limit strap terminus, the first and second limit strap terminuses defining opposite points at which the limit strap terminates; and a shock-absorption strap stretchable from an unstretched state, the shock-absorption strap in the unstretched state hanging to form a second loop having a second lower-most extremity spaced above a first lower-most extremity of the first loop in the vertical direction, the shock-absorption strap having a shock-absorption strap length extending downward and upward along the second loop, the shock-absorption strap length measured along the second loop and between a first shock-absorption strap terminus and a second shock-absorption strap terminus, the first and second shock-absorption strap terminuses defining opposite points at which the shock-absorption strap terminates, wherein the shock-absorption strap is attached to the limit strap so that the first shock-absorption strap terminus is located at the first limit strap terminus, the second limit strap terminus, or along the limit strap length between the first and second limit strap terminuses.

11. The plate retention system of claim 10, wherein the limit strap is connected to the first wall and the second wall of the pocket; and wherein the shock-absorption strap is configured to receive a bottom edge of the plate, the shock-absorption strap configured to stretch in the vertical direction so as to provide shock absorption in response to movement of the plate resulting from movement of the wearer when the carrier is worn.

12. The plate retention system of claim 10, wherein the first upper location and the second upper location are each positioned to be above a bottom edge of the plate when an upper edge of the plate is received along a top of the pocket.

13. The plate retention system of claim 10, wherein the first upper location and the second upper location are each on the first wall with the second upper location being above the first upper location; and wherein the limit strap comprises one or more straps connectable to reach from the first upper location to the second upper location.

14. The plate retention system of claim 10, wherein at least one of the limit strap or the shock-absorption strap is releasably attached within the pocket.

15. A plate retention system, comprising:

a carrier configured to be worn on a body of a wearer;

a pocket configured for removably receiving a plate, the pocket coupled with the carrier and configured to be located along the body of the wearer when the carrier is worn by the wearer, the pocket having a vertical direction configured to be aligned with a direction of gravity when the carrier is worn by the wearer when the wearer is in an upright position; and an interior of the pocket being formed at least in part by a first wall and a second wall facing one another;

a cradle configured for supporting the plate within the pocket from underneath the plate in the vertical direction, the cradle comprising at least one strap configured to be folded over a bottom edge of the plate when the plate is received in the pocket, the cradle further comprising a first anchor configured for coupling the at least one strap with the first wall, the cradle further comprising a second anchor configured for coupling the at least one strap with the first wall or the second wall;

a base material incorporated into the first wall; and a stretchable material incorporated into the cradle, the base material and stretchable material having respective levels of force-responsive extension that differ by an amount that facilitates temporary dislocation of the plate downwardly along the first wall within the pocket in response to movement of the wearer when the carrier is worn and thereby provide shock absorption of the plate responsive to the movement of the wearer;

wherein the stretchable material is incorporated into the cradle in the first anchor, in the second anchor, or in both the first anchor and the second anchor; and wherein the at least one strap comprises a material that is less stretchable than the stretchable material incorporated into the cradle in the first anchor, in the second anchor, or in both the first anchor and the second anchor.

16. The plate retention system of claim 15, wherein the stretchable material is incorporated into the cradle in the at least one strap.

17. The plate retention system of claim 16, wherein the at least one strap comprises:

a limit strap connected at a first upper location and at a second upper location to the interior of the pocket and hanging to form a first loop; and a shock-absorption strap comprising the stretchable material and stretchable from an unstretched state, the shock-absorption strap in the unstretched state hanging to form a second loop spaced above the first loop in the vertical direction.

* * * * *